US005887569A

United States Patent [19]

Romanelli et al.

[11] Patent Number: 5,887,569

[45] Date of Patent: Mar. 30, 1999

[54] CENTRIFUGAL FUEL DISTRIBUTOR

[75] Inventors: Patrick Romanelli; Robert James Romanelli, both of Harrington, N.J.

[73] Assignee: Pacer Industries, Inc., Pensacola, Fla.

[21] Appl. No.: 895,664

[22] Filed: Jul. 17, 1997

[51] Int. Cl.[6] ..... F02M 55/04

[52] U.S. Cl. ..... 123/450; 137/625.11

[58] Field of Search ..... 123/450, 506, 123/510; 137/625.2, 625.11

[56] References Cited

U.S. PATENT DOCUMENTS

| | | | |
|---|---|---|---|
| 1,292,981 | 1/1919 | Weiss | 123/450 |
| 2,210,067 | 8/1940 | Cummins | 123/450 |
| 2,871,845 | 2/1959 | Holley | 123/450 |
| 2,888,098 | 5/1959 | Florence | 137/625.11 |
| 3,664,318 | 5/1972 | Giuffra . | |
| 3,810,581 | 5/1974 | Rhine et al. . | |
| 3,995,494 | 12/1976 | Muller et al. | 137/625.11 |
| 4,305,417 | 12/1981 | Bell, Jr. | 137/625.11 |
| 4,709,673 | 12/1987 | Babitzka . | |
| 4,840,162 | 6/1989 | Brunel | 123/450 |
| 4,913,632 | 4/1990 | Thornthwaite . | |
| 5,383,436 | 1/1995 | Fehlmann | 123/450 |

*Primary Examiner*—Thomas N. Moulis
*Attorney, Agent, or Firm*—St. Onge Steward Johnson & Reens LLC

[57] ABSTRACT

A centrifugal fuel distributor including a drive shaft rotatably mounted within a housing having a distribution cavity. A sidewall of the distribution cavity defines a plurality of spaced-apart fuel outlets, and a hollow armature is biased radially outwardly from the drive shaft, so that a distal end of the armature is in sealing contact with an inner surface of the sidewall. During operation, pressurized fuel travels through a fuel passage in the drive shaft and through the hollow armature while the drive shaft is rotated, so that the distal end of the armature slides along the inner surface of the sidewall of the distribution cavity and sequentially distributes fuel to the plurality of fuel outlets. The fuel then passes from each fuel outlet to fuel injectors mounted in cylinders of an engine incorporating the fuel distributor. A timing rotor is secured to the drive shaft and signals the position of the armature as the drive shaft rotates to an actuator controlling fuel flow, so that the actuator allows the fuel passage to be replenished with pressurized fuel each time the hollow armature distribute fuel to a fuel outlet.

17 Claims, 5 Drawing Sheets

CENTRIFUGAL FUEL DISTRIBUTOR

FIELD OF THE INVENTION

The present invention relates to an internal combustion engine and, more particularly, to a fuel injection system for use with an internal combustion engine. Even more particularly, the invention relates to a centrifugal fuel distributor for use as part of a fuel injection system.

BACKGROUND OF THE INVENTION

In conventional fuel delivery systems for internal combustion engines, a constant-delivery fuel pump supplies fuel under pressure from a tank to a fuel rail positioned on the engine. A plurality of fuel injectors are mounted between the fuel rail and the engine intake manifold, with the injector nozzles being positioned adjacent to the fuel/air intake ports of the individual engine cylinders. The fuel injectors are individually electromagnetically actuated by an engine control unit as a function of operating conditions and parameters at the engine.

A major cost associated with fuel delivery systems of the described character lies in the individual fuel injectors, and in the complexity of electrical conductors that connect the fuel injectors to the engine's electronic control unit. In addition, the fuel injectors are subject to wear, and may eventually feed differing quantities of fuel to the cylinders even when actuated for nominally identical time durations, thus resulting in less than optimum engine operation. Furthermore, conventional fuel injectors present additional difficulties when employed in conjunction with so-called alternative fuels. Fuels of this character have lower lubricity than conventional gasoline fuels, increasing wear at the individual injectors. The injector wear parts may be constructed of stainless steel to reduce wear, but this greatly increases cost. Moreover, because of lower energy content of alcohol-based alternative fuels, for example, the injectors must have a larger fuel opening and/or remain open longer than would otherwise be desirable in operation with gasoline. Thus, conventional fuel injectors are not well suited for use in association with engines intended for operation with alternative fuels having differing potential energy contents.

U.S. Pat. No. 3,664,318 to Giuffra discloses a fuel injection system not requiring conventional fuel injectors. The system includes a distributor housing fixed in a housing above a distribution cavity. A shaft is rotatably mounted in the housing and passes through the distribution cavity and the distributor housing. The distributor housing defines an aperture for each cylinder of an engine, and each aperture connects the distribution cavity with a fuel outlet of the housing. A flat, plate-like distributor rotor is secured to the shaft within the distribution cavity, blocking the apertures of the distributor housing. During operation, the distribution cavity is filled with fuel and the shaft and the distributor rotor are rotated. The distributor rotor defines a rotor aperture that sequentially aligns with each of the apertures in the distributor housing as the rotor rotates, so that fuel can pass to the fuel outlets and to fuel injectors in the engine cylinders.

One drawback of the Giuffra system is that the distributor cavity must be filled with fuel during operation before the fuel is distributed to the fuel outlets. Filling the distributor cavity, however, requires a complex fuel pumping means which adds many parts and increases the complexity of the distributor. What is desired, therefore, is a distributor that distributes fuel directly to fuel outlets without requiring that the distributor cavity be filled with fuel.

SUMMARY OF THE INVENTION

A general object of the present invention is to provide an improved fuel injection system for use as part of an internal combustion engine that enhances engine performance and fuel economy, and reduces emissions.

A more particular object of the present invention is to provide an improved fuel distributor for use as part of a fuel injection system of an internal combustion engine.

Another object of the present invention is to provide a fuel distributor that eliminates the need for conventional electromagnetic fuel injectors, thereby achieving reduced cost, reduced complexity, reduced wear and increased operating life.

An additional object of the present invention is to provide a fuel distributor that automatically delivers identical quantities of fuel to all of the engine cylinders, and automatically controls fuel quantity over a wide flow range with multiple fuel types.

A further object of the present invention is to provide a relatively simply fuel distributor that distributes fuel directly to fuel outlets without requiring that the distributor be filled with fuel, thereby eliminating the need for a complex fuel pumping means within the distributor.

These and other objects of the present invention are achieved by an apparatus for distributing fuel from a pressurized fuel source. The apparatus includes a housing having a sidewall and a plurality of spaced-apart fuel outlets in the sidewall. A drive shaft is mounted within the housing so that it can be rotated, and an armature is connected to the drive shaft and has a distal end. A fuel passage, for communicating in a fluid manner with the fuel source, extends to the distal end of the armature for sequentially being in fluid communication with the fuel outlets upon rotation of the drive shaft. The apparatus also includes a spring biasing the distal end of the armature into sealing engagement with the sidewall of the housing.

The present invention, therefore, provides an apparatus, and more particularly a fuel distributor, that distributes fuel directly to the fuel outlets without requiring that the housing of the distributor be filled with fuel, thereby eliminating the need for a complex fuel pumping means within the distributor.

According to one aspect of the present invention, an apparatus for distributing fuel from a pressurized fuel source is provided. The apparatus includes a housing having a sidewall and a fuel outlet in the sidewall. An armature has a fuel passage, for communicating in a fluid manner with the fuel source, extending to a distal end of the armature. The apparatus also has a spring for biasing the distal end of the armature into sealing engagement with the sidewall of the housing to bring the fuel passage into fluid communication with the fuel outlet.

According to another aspect of the present invention, an apparatus for distributing fuel from a pressurized fuel source is provided. The apparatus includes a housing having a sidewall, and a plurality of spaced-apart fuel outlets in the sidewall. A drive shaft is rotatably mounted within the housing, and an armature is connected to the drive shaft and has a distal end in sliding contact with an inner surface of the sidewall. A fuel passage, for communicating in a fluid manner with the fuel source, extends to the distal end of the armature for sequentially being in fluid communication with each of the fuel outlets upon rotation of the drive shaft.

The invention and its particular features and advantages will become more apparent from the following detailed description considered with reference to the accompanying drawings.

DETAILED DESCRIPTION OF THE INVENTION

Figure 1:
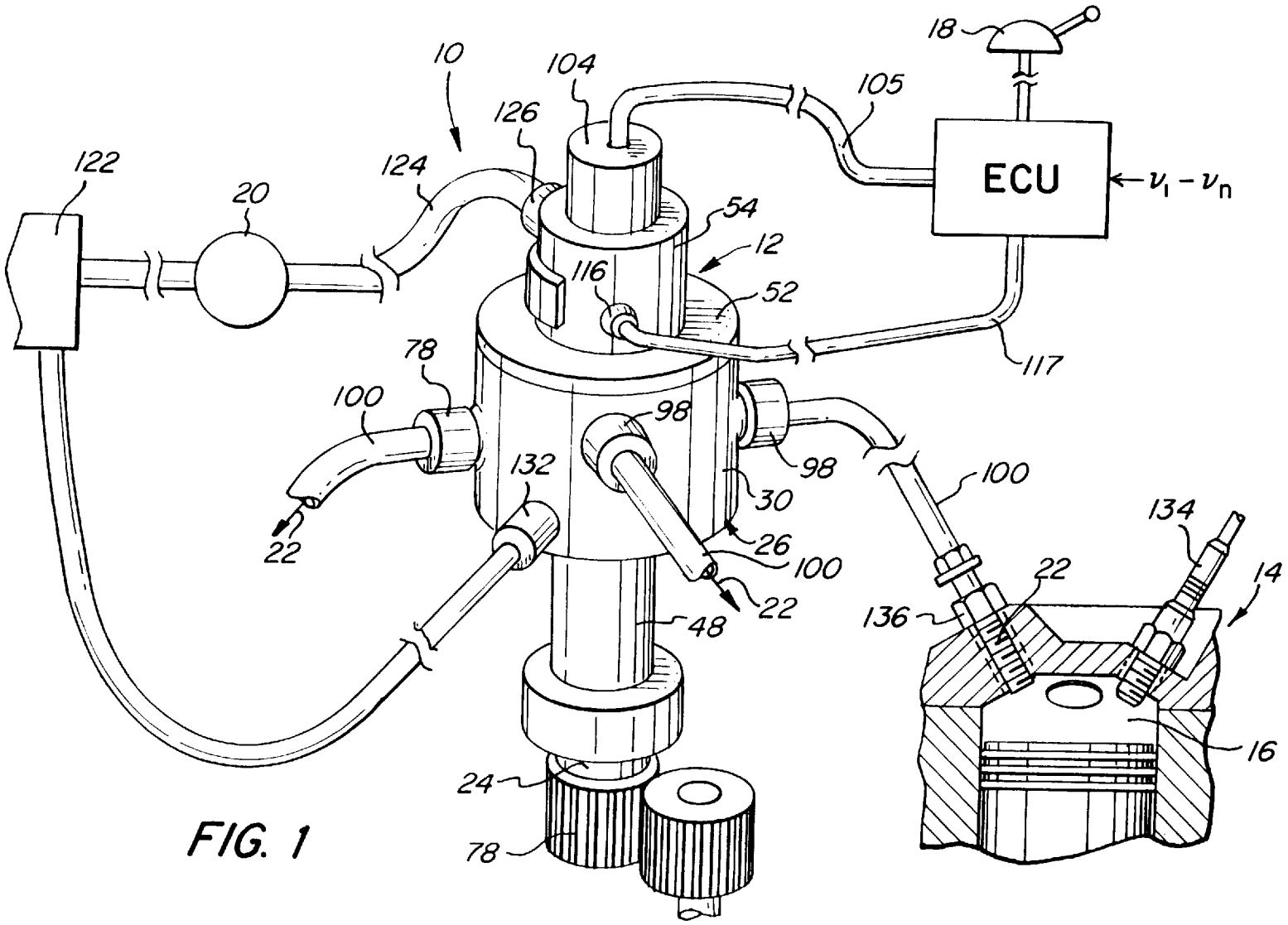
FIG. 1 is a front isometric view of a centrifugal fuel distributor according to the present invention illustrated connected to schematic representations of an internal combustion engine and a fuel injection system.
Figure 2:
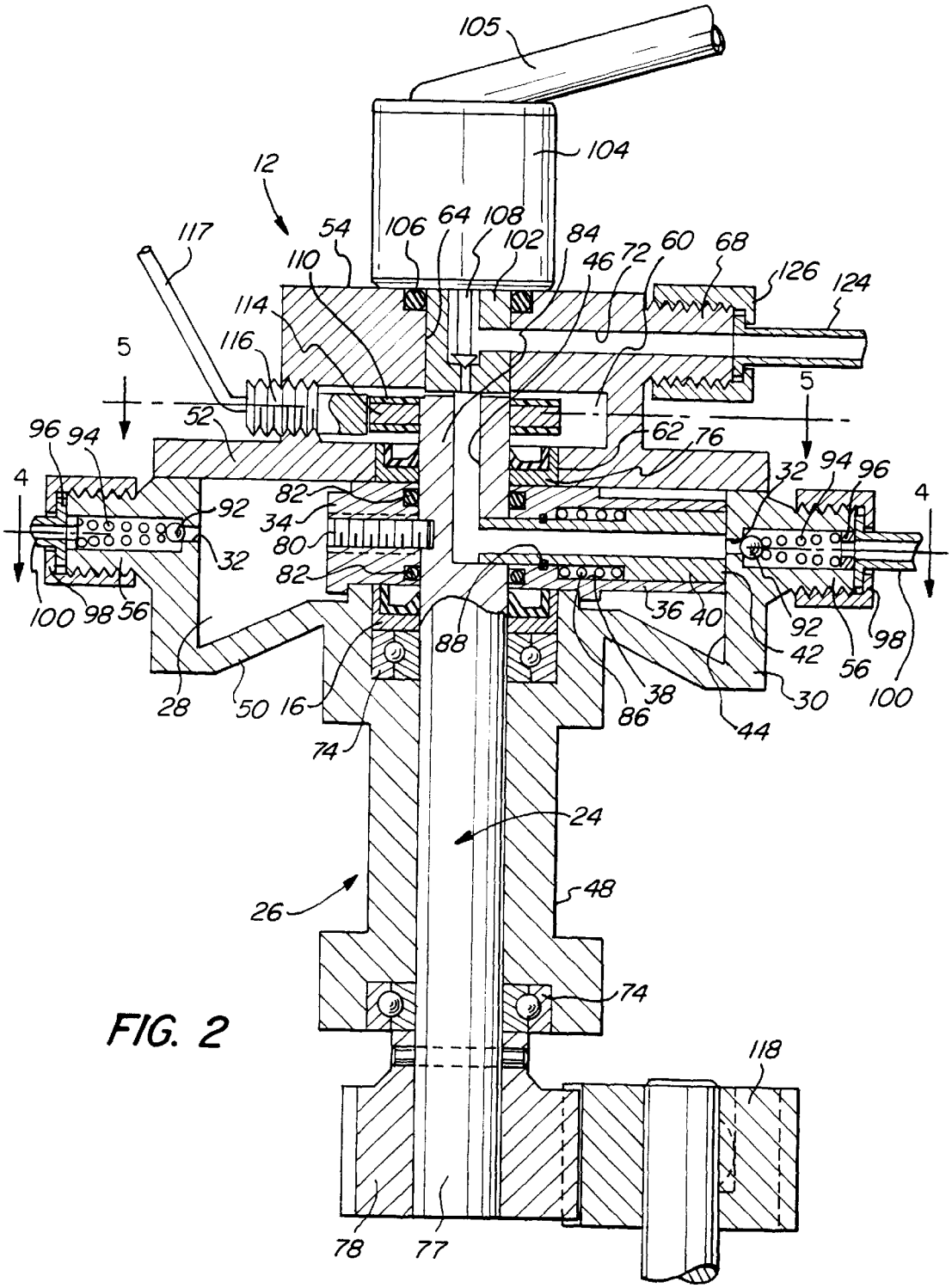
FIG. 2 is a front cross-sectional view of the fuel distributor of FIG. 1.
Figure 3:
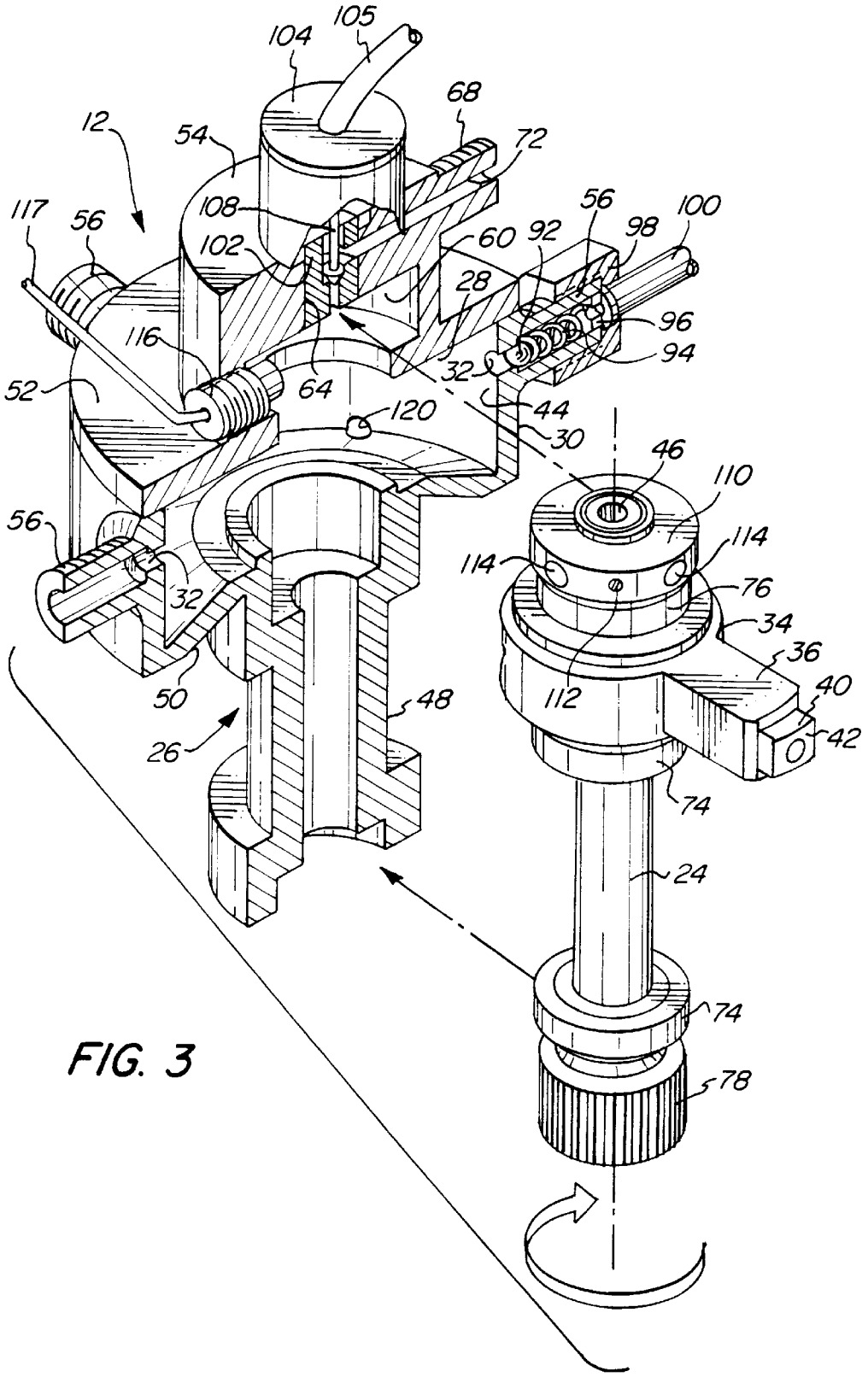
FIG. 3 is a side isometric, cross-sectional view of the fuel distributor of FIG. 1, partially exploded to illustrate a drive shaft.

Referring first to FIG. 1, the present invention provides a fuel injection system 10 including a centrifugal fuel distributor 12 for use with an internal combustion engine 14 having, in the embodiment shown, four cylinders 16 (only one is shown). The fuel distributor 12 is ultimately controlled by a throttle 18 of the engine 14, and in general, equally distributes pressurized fuel from a pressurized fuel supply 20 to mechanical fuel injectors 22 mounted in the cylinders 16 of the engine. The present invention, accordingly, eliminates conventional electromagnetic fuel injectors, thereby achieving reduced cost, reduced complexity, reduced wear and increased operating life. The present invention also automatically delivers identical quantities of fuel to all the engine cylinders 16, and automatically controls fuel quantity over a wide flow range with multiple fuel types. The fuel distributor 12 is for use with gasoline or alternative fuels such as gasohol or natural gas, for example.

As also shown in FIGS. 2–5, the fuel distributor 12 includes a drive shaft 24 rotatably mounted within a housing 26 having a distribution cavity 28. A sidewall 30 of the distribution cavity 28 has a plurality of spaced-apart fuel outlets 32. A rotor 34 is secured to the drive shaft 24 within the distribution cavity 28 and has a rotor arm 36 extending radially therefrom, with a hole 38 extending through the rotor 34 and the rotor arm 36. A member such as a hollow armature 40 is mounted in the hole 38 and biased outwardly, so that a distal end 42 of the armature 40 is in sealing engagement with an inner surface 44 of the sidewall 30 of the distribution cavity 28. During operation, the drive shaft 24 is rotated so that the rotor 34, the rotor arm 36 and the armature 40 are also rotated, with the distal end 42 of the armature 40 sliding along the inner surface 44 of the sidewall 30 of the distribution cavity 28 and sequentially aligning with the fuel outlets 32. Fuel travels through a fuel passage 46 in the drive shaft 24 and through the hollow armature 40 and is sequentially distributed to the fuel outlets 32 as the distal end 42 of the armature sequentially aligns with each fuel outlet. The fuel then passes to the fuel injectors 22 in the cylinders 16 of the engine 14. The fuel passage 46, in effect, extends through the hollow armature 40 to sequentially communicate, in a fluid manner, with the fuel outlets 32.

The housing 26 of the distributor is generally cylindrical and includes a tubular trunk 48 extending to a base 50, the sidewall 30 extending from the base to a cover 52, and a cap 54 extending from the cover. The sidewall 30 includes the fuel outlets 32, which in the embodiment shown equal four, although the distributor can be provided with any number of fuel outlets depending on the number of cylinders 16 of the engine 14 and the number of the fuel injectors 22 in each cylinder. The fuel outlets 32 are equally spaced from each other and equally spaced from the base 50. A threaded, hollow boss 56 extends outwardly from the sidewall 30 at each of the fuel outlets 32.

The cover 52, sidewall 30 and base 50 cooperate to define the distribution cavity 28. The cap 54 includes a timing cavity 60 above the cover 52 communicating with the distribution cavity 28 through an opening 62 in the cover 52. A central bore 64 extends through the cap 54 to the timing cavity 60, and a threaded boss 68 extends radially outwardly from the cap 54, and the boss and the cap define a fuel inlet 72 communicating with the central bore.

The drive shaft 24 extends through the trunk 48, the distribution cavity 28, and into the timing cavity 60, coaxially with the sidewall 30, and is rotatably mounted with a pair of bearings 74, and a pair of gasket/supports 76. A gear 78 is coaxially secured to a second end 77 of the drive shaft 24. The rotor 34 is coaxially secured to the drive shaft 24 within the distribution cavity 28 with a setscrew 80, for example, and made liquid tight with gaskets 82. The fuel passage 46 extends from a first end 84 of the drive shaft 24 to at least level with the rotor 34. The rotor arm 36 extends radially outwardly from the rotor 34, normal to the drive shaft 24 and the sidewall 30, and the hole 38 defined by the rotor 34 and rotor arm 36 communicates with the fuel passage 46 of the drive shaft 24. The hollow armature 40 is mounted in the hole 38 and biased outwardly with a spring 86, so that the distal end 42 of the armature 40 is in sealing engagement with the inner surface 44 of the sidewall 30 of the distribution cavity 28 and level with the fuel outlets 32. The hollow armature 40, therefore, communicates with the fuel passage 46 of the drive shaft 24, and a gasket 88 is provided between the armature 40 and the hole 38. In effect, the fuel passage 46 extends to the distal end 42 of the hollow armature 40.

A ball valve 92 is provided at each fuel outlet 32 in the hollow boss 56, and biased against the fuel outlet with a spring 94 secured with a washer 96. The biased ball valve 92, therefore, allows fuel flow, at sufficient pressure, out of the fuel outlets 32 from the armature 40 but prevents fuel flow through the fuel outlets into the distribution cavity 28. Endcaps 54 are threaded to the bosses 56, securing the ball valves 92 and connecting the fuel outlets 32 to injector lines 100.

A pintle seat 102 is provided in the central bore 64 of the cap 54, between the fuel inlet 72 and the fuel passage 46 of the drive shaft 24. An actuator 104 is secured on the cap 54 and made liquid tight with a gasket 106. A pintle 108 extends from the actuator 104 into the pintle seat 102 to control fuel flow between the fuel inlet 72 and the fuel passage 46 in the drive shaft 24. The actuator 104 is an electromagnetic linear actuator having coils (not shown) receiving control signals, through transmission line 105 from an electronic control unit (ECU) of the engine 14 for controlling the position of the pintle 108. It should be noted that the linear actuator 104 may be replaced by a stepper motor, or by an electric motor and screw/rack arrangement.

A timing rotor 110 is secured to the drive shaft 24 with a setscrew 112, for example, and four pole pieces 114 of magnetic material are positioned in the timing rotor equally spaced-apart. The number of pole pieces 114 provided is normally equal to the number of fuel outlets 32. A magnetic detector trigger 116 adjustably extends through the side of the cap 54 into the timing cavity 60 adjacent to the timing rotor 110, and provides a signal to the ECU, through transmission line 117, each time a pole piece 114 passes as the timing rotor 110 rotates. The timing rotor 110 and the trigger 116, in effect, tell the ECU the position of the armature 40, so that the ECU will know when the armature has distributed fuel to a fuel outlet 32 and the fuel passage 46 of the drive shaft 24 is in need of replenishment. An access port 111 and a cover 113 are provided for access to adjust the timing rotor 110. Alternatively, the timing rotor 110 and trigger 116 can be replaced by other timing signal devices for signaling the position of the armature such as a mechanical clicker attachable to the drive shaft 24, for example.

Figure 4:
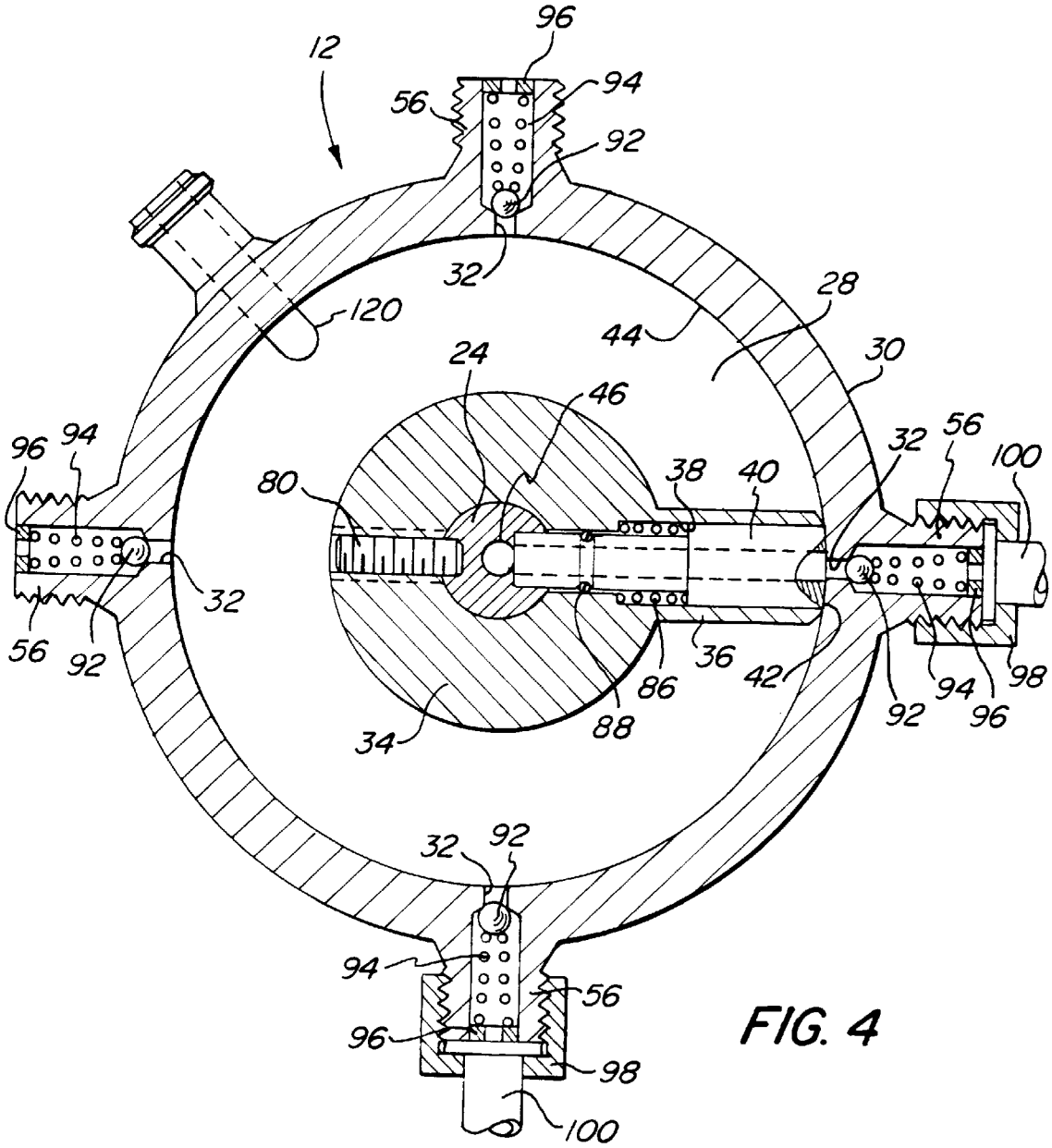
FIG. 4 is a top cross-sectional view of the fuel distributor of FIG. 1 taken along 4—4 in FIG. 2.
Figure 5:
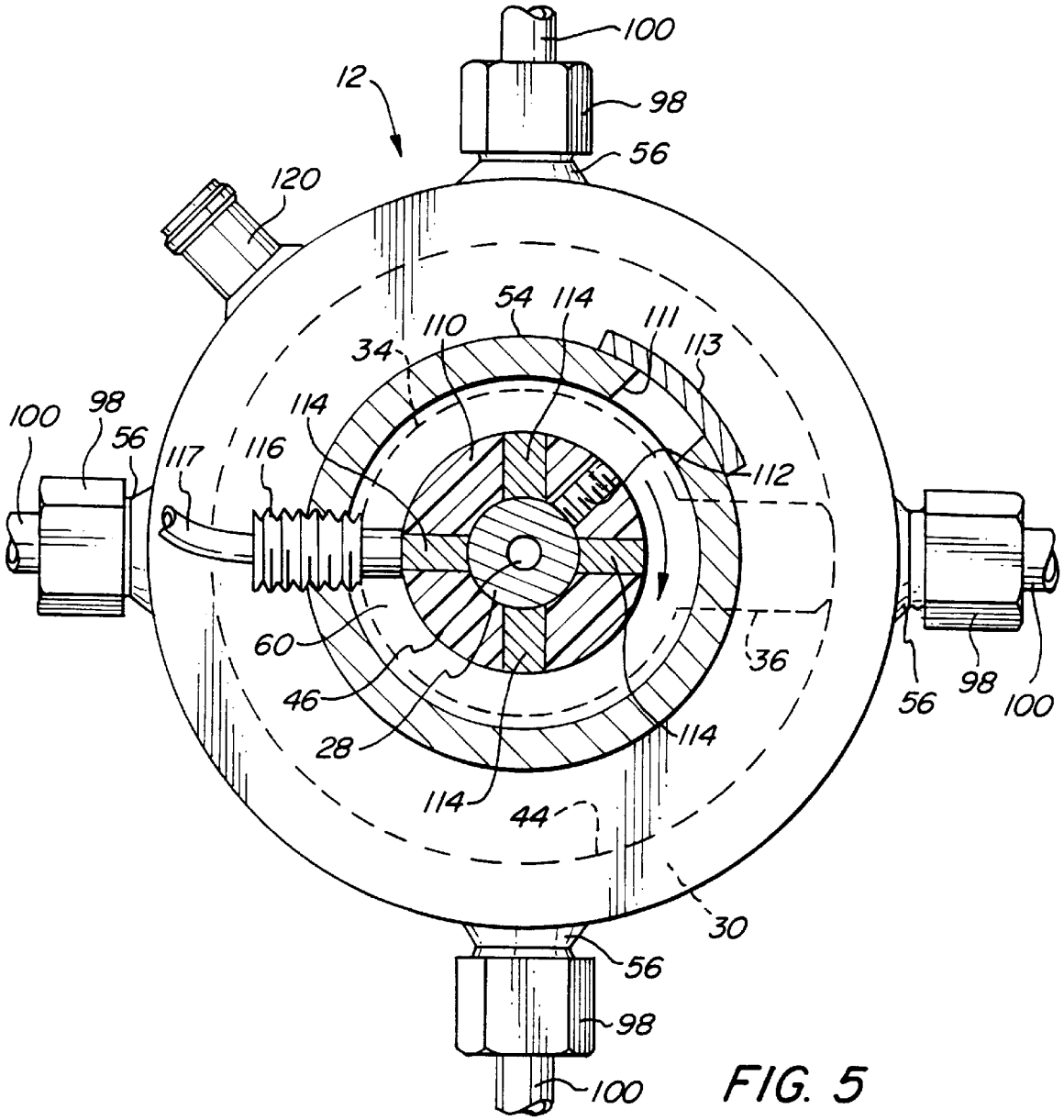
FIG. 5 is a top cross-sectional view of the fuel distributor of FIG. 1 taken along 5—5 in FIG. 2.

The gear 78 of the drive shaft 24 is mated with a drive gear 118 of the engine 14 to provide power to the distributor 12. During operation, the drive gear 118 rotates the drive shaft 24, thereby turning the distributor rotor 34 and the timing rotor 110. As the distributor rotor 34 turns, the distal end 42 of the biased armature 40 slides along the inner surface 44 of the sidewall 30 of the housing 26 and sequentially aligns with the fuel outlets 32. Preferably the armature 40 is made of, or coated with, a reduced friction material such as polytetrafluoroethylene (TEFLON®), and the inner surface 44 is highly polished to reduce friction. Due to the spring 86, and centrifugal forces biasing the armature 40 against the inner surface 44, fuel normally is prevented from leaking between the distal end 42 of the armature and the inner surface. As shown in FIG. 4, however, an excess fuel return 120 is provided in the base 50 of the housing 26 for returning fuel leakage to a fuel tank 122 of the vehicle. As the distal end 42 aligns with one of the fuel outlets 32 (or in other words, as the hollow armature 40 communicates, in a fluid manner, with the fuel outlet), fuel from the armature 40 opens the ball valve 92 and flows through the fuel outlet. In addition to the pressure created by the pressurized fuel source 20, centrifugal forces help force the fuel past the ball valves 92.

As the timing rotor 110 rotates, the trigger 116 signals the ECU each time a pole piece 114 passes. The ECU can then consider the trigger 116 signal, along with the throttle 18 position and the other engine variables $v_1$–$v_n$, such as engine temperature and intake manifold pressure for example, as is known in the art. The ECU can in-turn signal the actuator 104 to withdraw the pintle 108 from the pintle seat 102 and allow fuel flow from the fuel inlet 72 to the fuel passage 46 in the drive shaft 24.

In addition to the centrifugal fuel distributor 12, the fuel injection system 10 includes a fuel inlet line 124 attached to the boss 68 of the fuel inlet 72 of the distributor with a threaded endcap 126. The fuel inlet 72 line provides pressurized fuel from the pressurized fuel supply 20, which can include a fuel pump, as is known in the art, for receiving fuel from the fuel tank 122 of the vehicle. At least one of the fuel injector lines 100 connects each fuel outlet 32 to one of the fuel injectors 22 mounted in the cylinders 16 of the engine 14, so that fuel flow through the fuel outlets 32 of the distributor ultimately enters the cylinders. It should be noted that the endcaps 54 of the fuel outlets 32 can alternatively include T-fittings for connection to two fuel injector lines 100. The fuel injectors 22 are preferably conventional poppet-type injectors, which open in response to pressure of fuel in the fuel injector line 100, and close when there is no pressure in the line to prevent backflow. The fuel injectors 22 atomize, or provide a fine spray of, the fuel into the cylinder 16 of the engine 14. The atomized fuel is then ignited by a glow plug or spark plug 134 in the cylinder 16. The positions of the fuel injectors 22 within the cylinder 16 can be adjusted with locking nuts 136 to optimize performance. It should be noted that the poppet-type injectors 22 can be replaced with other conventional mechanical means or devices for atomizing fuel delivery to the cylinders 16.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An apparatus for distributing fuel comprising:

a housing having a sidewall;

a plurality of spaced-apart fuel outlets in the sidewall;

a drive shaft mounted within the housing so that it can be rotated;

an armature connected to the drive shaft and having a distal end in sliding contact with the sidewall of the housing;

a fuel passage extending to the distal end of the armature for sequentially being in fluid communication with the fuel outlets upon rotation of the drive shaft;

a spring biasing the distal end of the armature into sealing engagement with the sidewall of the housing; and a pressurized fuel source in constant fluid communication with said fuel passage to force fuel out of the fuel outlets.

2. An apparatus according to claim 1 further comprising an actuator for controlling fuel flow to the fuel passage.

3. An apparatus according to claim 2 further comprising:

a pintle seat positioned in the fuel passage; and a pintle extending from the actuator into the pintle seat, the pintle controlled by the actuator to open or close the pintle seat.

4. An apparatus according to claim 2 further comprising a timing rotor secured to the drive shaft for signaling the actuator with respect to the position of the armature as the drive shaft rotates.

5. An apparatus according to claim 1 further comprising a timing rotor secured to the drive shaft for signaling the position of the armature as the drive shaft rotates.

6. An apparatus according to claim 1 further comprising a valve at each fuel outlet allowing fuel flow out of the housing but preventing fuel flow into the housing.

7. A fuel injection system including an apparatus according to claim 1 and further comprising:

at least one fuel injector connected to each fuel outlet; and a pressurized fuel supply connected to the fuel passage.

8. An apparatus for distributing fuel comprising:

a housing having a sidewall and a fuel outlet in the sidewall;

an armature having a fuel passage extending to a distal end of the armature;

a spring biasing the distal end of the armature into sealing engagement with the sidewall of the housing to bring the fuel passage into fluid communication with the fuel outlet; and a pressurized fuel source in constant fluid communication with said fuel passage to force fuel out of the fuel outlet.

9. An apparatus according to claim 8 further comprising an actuator for controlling fuel flow to the fuel passage.

10. A fuel injection system including an apparatus according to claim 8 and further comprising:

at least one fuel injector connected to the fuel outlet; and a pressurized fuel supply connected to the fuel passage.

11. An apparatus for distributing fuel comprising:

a housing having a sidewall;

a plurality of spaced-apart fuel outlets in the sidewall;

a drive shaft rotatably mounted within the housing;

an armature connected to the drive shaft and having a distal end in sliding contact with an inner surface of the sidewall of the housing;

a fuel passage extending to the distal end of the armature for sequentially being in fluid communication with each of the fuel outlets upon rotation of the drive shaft; and a pressurized fuel source in constant fluid communication with said fuel passage to force fuel out of the fuel outlets.

12. An apparatus according to claim 11 further comprising an actuator for controlling fuel flow to the fuel passage.

13. An apparatus according to claim 12 further comprising:

a pintle seat positioned in the fuel passage; and a pintle extending from the actuator into the pintle seat, the pintle controlled by the actuator to open or close the pintle seat.

14. An apparatus according to claim 12 further comprising a timing rotor secured to the drive shaft for signaling the actuator with respect to the position of the armature as the drive shaft rotates.

15. An apparatus according to claim 11 further comprising a timing rotor secured to the drive shaft for signaling the position of the armature as the drive shaft rotates.

16. An apparatus according to claim 11 further comprising a valve at each fuel outlet allowing fuel flow out of the housing but preventing fuel flow into the housing.

17. A fuel injection system including an apparatus according to claim 11 and further comprising:

at least one fuel injector connected to each fuel outlet; and a pressurized fuel supply connected to the fuel passage.

* * * * *